US005445093A

United States Patent [19]

Lilly, Jr.

[11] Patent Number: 5,445,093

[45] Date of Patent: Aug. 29, 1995

[54] UNLOADING FACILITY FOR FLEXIBLE WATER TRANSPORTING BARGES

[75] Inventor: Kenneth E. Lilly, Jr., Bothell, Wash.

[73] Assignee: Terry Spragg, Manhattan Beach, Calif.

[21] Appl. No.: 248,064

[22] Filed: May 23, 1994

[51] Int. Cl.[6] ..... B65D 88/78

[52] U.S. Cl. ..... 114/45; 114/74 T; 114/256; 114/263

[58] Field of Search ..... 114/44, 45, 48, 49, 114/256, 257, 74 T, 263

[56] References Cited

U.S. PATENT DOCUMENTS

| | | | |
|---|---|---|---|
| 2,990,796 | 7/1961 | Cole et al. | 114/257 |
| 3,133,443 | 5/1964 | Timmerman | 114/257 |
| 3,416,479 | 12/1968 | Strohmeier | 114/45 |

*Primary Examiner*—Jesus D. Sotelo
*Attorney, Agent, or Firm*—Seed and Berry

[57] ABSTRACT

A flexible barge containing fresh water is unloaded on a dry dock which is gradually raised from a submerged condition as the fresh water is pumped out of the barge. The deck of the dry dock is formed with a basin adjacent one end thereof and the dry dock is tilted near the end of the unloading operation so that water will drain in the barge toward the basin and collect in the barge in the basin to be pumped out.

18 Claims, 2 Drawing Sheets

UNLOADING FACILITY FOR FLEXIBLE WATER TRANSPORTING BARGES

TECHNICAL FIELD

The present invention relates to flexible barges for transporting fresh water, and more particularly to a facility for unloading the fresh water from such a barge.

BACKGROUND OF THE INVENTION

Transporting of fresh water in a floating flexible barge (hereinafter "FB") towed on salt water seas from a region with excess fresh water to a region having shortages has been proposed. This requires the use of special handling facilities for emptying the FBs and delivering the fresh water into a municipal pipeline or other water transport or storage facility. A typical FB would be formed from a suitable fabric material such as vinyl and could be 500 feet long and about 50 feet in diameter, with a draft of about 30 feet. Such an FB would hold more than 6,000,000 gallons of fresh water and displace nearly 24,000 long tons. The FB would have a front towing bridle for connection to a towing line from a tug and for receiving mooring lines, and preferably would have aft fittings for mooring lines. The present invention is directed at providing an FB handling facility and unloading procedure which makes speedy handling and unloading of an FB possible, and does so in a practical and economically feasible manner.

SUMMARY OF THE INVENTION

In accordance with the invention a concrete float is provided as a working platform which is used in conjunction with one or more elongated submersible floats, hereinafter called dry docks, for gradually raising FBs docked adjacent the working platform as they are being emptied. Each dry dock is capable of handling an FB, and has divided ballast tanks adjacent the ends of its hull to adjust the trim and pitch of the dry dock as well as its draft. A basin is preferably provided at the working platform end of the dry dock beneath an adjustable discharge pipe which is connected to the suction side of a suitable pump on the working platform, and depends, from a crane on the working platform into a discharge port in the FB. The portion of the FB seated in this basin is kept filled with fresh water near the end of the unloading procedure by longitudinally tilting the dry dock by approximate manipulation of the amount of ballast in the ballast tanks. In this manner the FB can be substantially completely emptied.

DETAILED DESCRIPTION OF THE DRAWINGS

Figure 1:
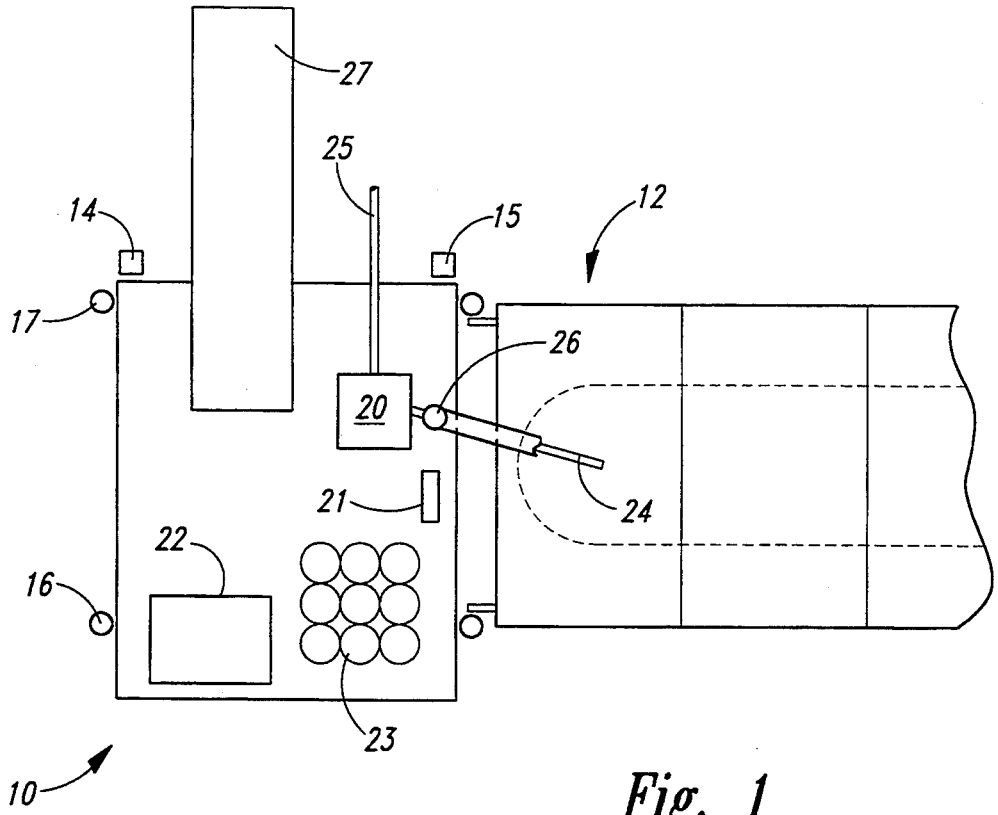
FIG. 1 is a plan view of a layout of an unloading facility in accordance with the invention.
Figure 2:
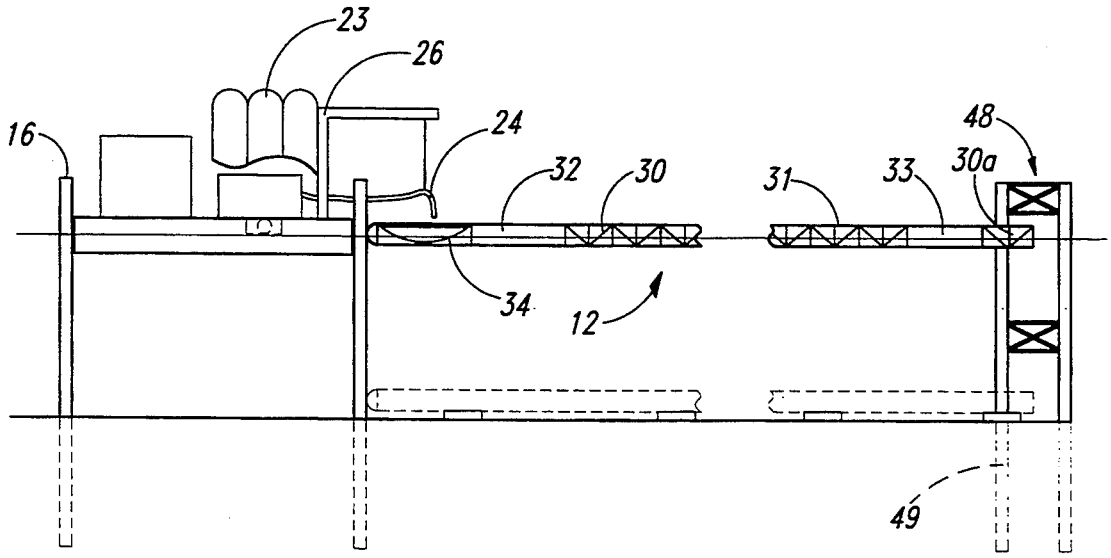
FIG. 2 is an elevational view of the facility with the dry dock raised and shown in vertical section.

Referring to the drawings, for purposes of example an FB unloading facility is illustrated for handling a single FB at a time. The facility comprises a working platform 10 and a submersible elongated float 12 (dry dock). Preferably the platform 10 is a concrete float to compensate for tide changes. Typically the floating platform 10 is moored by a pair of slides acting on a pair of positioning piles 14–15 at one end of the float and positioning is assisted by additional pairs of front and back guide piles 16–17. The platform 10 carries a pump 29, a mooring winch 21, a shed 22 with air compressors, and a bank of compressed air receivers 23 charged by the air compressors. The suction side of the pump 20 is connected to a suction hose 24 and the discharge side of the pump is connected to a pipe 25 leading to a main. The suction hose 24 is adjustably suspended over the dry dock 12 by the reach boom of a crane 26. Preferably the crane mast is telescopic and/or the boom is swing-mounted on the mast so that the discharge hose can be easily manipulated vertically and horizontally. A ramp 27 gives access to the platform 10 from an adjacent stationary dock or other shoreside facility.

The dry dock 12 comprises an elongated hull 30 having a deck 31 and fore and aft ballast tanks 32, 33. Forwardly of the front ballast tank 32 the deck 31 has a bowl-shaped basin 34. Preferably the ballast tanks 32, 33 are each divided into port and starboard compartments which are connected by suitable pipes and flexible hoses to the bank 23 of compressed air storage receivers for selectively supplying compressed air to the compartments in the ballast tanks 32, 33. These compartments also have discharge lines extending from their lower ends to valves on the platform 10 for discharging ballast water responsive to introduction of compressed air to the ballast tank compartments from the compressed air receivers 23.

The dry dock hull 30 extends rearwardly of the aft ballast tank 33 by a stern section 30*a* which extends between a pair of suitable vertical guide structures 48 supported by pilings 49. Preferably the deck 31 of the dry dock is made slightly concave across most of its width.

Figure 3A:
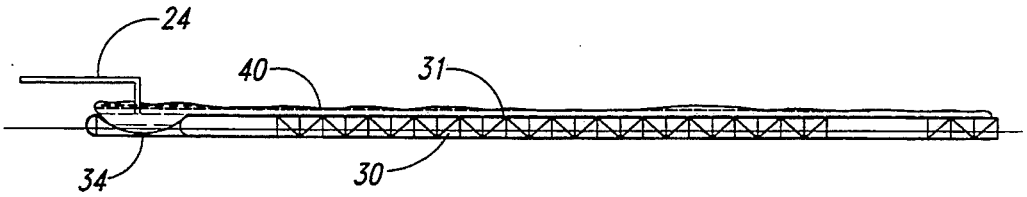
FIG. 3 shows in frames 3-A, 3-B and 3-C the operation of the unloading facility at the final stages of emptying a flexible barge.
Figure 3B:
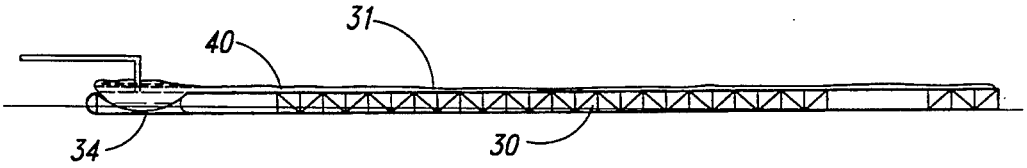
Figure 3C:
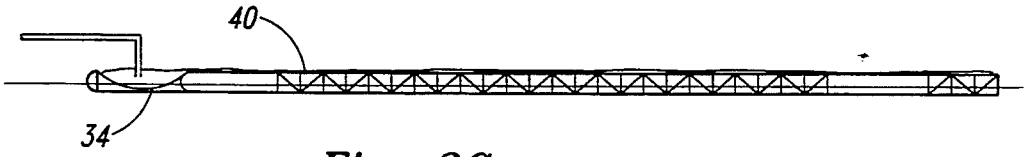

To empty a flexible barge 40 after it is moored over the dry dock 12 when the latter is submerged with the ballast tanks 32–33 filled with sea water. The suction hose 24 is then inserted into the barge through a port adjacent the forward end thereof. As the fresh water in the barge is pumped out the dry dock is gradually raised by introducing compressed air into the ballast tanks. FIG. 3 shows the final steps to empty the barge. In frame 3-A the dry dock is still submerged and the barge still contains water for substantially its full length. In frame 3-B the barge emptying operation has progressed to the point that the barge is nearly empty and the dry dock level is above the sea surface. Then the amount of sea water in the ballast tanks is adjusted so that the deck of the dry dock is pitched downwardly in the forward direction toward the float approximately 6 degrees. This causes the water remaining in the barge to drain forwardly. The portion of the flexible barge above the basin 34 will responsively depress into the basin to contain the remaining water. The portion of the barge occupying the basin is then pumped out as the dry dock is returned to a level condition (frame 3-C).

Although only one unloading berth has been shown and described, it will be appreciated that multi-berths can be provided at an unloading facility.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. Apparatus for emptying a flexible barge containing fresh water through an upper discharge port in the barge adjacent one end thereof, said apparatus comprising:

a submersible elongated dry dock having an upper support surface for supporting a said flexible barge, said support surface having a downwardly dished area adjacent one end of the dry dock;

ballast means associated with said dry dock for selectively raising and lowering the dry dock between a submerged position whereat a loaded said barge can be floated into a position overlying said support surface with said discharge port positioned above said area, and a raised position supporting the dry dock in an emptied condition; and water discharging means for emptying said barge through said discharge port as it is raised by said dry dock;

said downwardly dished area providing a corresponding downwardly dished discharge zone in said barge beneath said discharge port for collecting of water in the barge for discharge as emptying of the barge by the water discharging means nears completion.

2. Apparatus according to claim 1 in which said ballast means is adapted to selectively longitudinally tilt said dry dock so that said barge internally drains toward said discharge zone.

3. Apparatus according to claim 2 in which said ballast means comprises ballast tanks on said dry dock located adjacent opposite ends of the dry dock, and means for selectively filling either or both of said tanks with water and for selectively emptying either or both of said tanks.

4. Apparatus according to claim 2 in which said ballast means is also adapted to selectively laterally tilt said dry dock.

5. Apparatus according to claim 1 in which said discharging means includes a discharge pipe for entry into said barge through said discharge port, and includes means for adjusting the position of said discharge pipe.

6. Apparatus according to claim 5 in which said discharging means is carried on a floating dock adjoining said dry dock.

7. Apparatus according to claim 1 in which said ballast means comprises ballast tanks on said dry dock, a storage bank of compressed air tanks connected to said ballast tanks and located on a platform adjoining said dry dock, and air compressor means on said platform for supplying compressed air to said compressed air tanks.

8. Apparatus according to claim 7 in which said platform is provided by a floating dock.

9. Apparatus according to claim 1 in which said ballast means comprises ballast tanks on said dry dock located adjacent opposite ends of the dry dock, said ballast tanks each having compartments at opposite lateral sides thereof, and means for selectively filling and emptying said compartments whereby said dry dock can be selectively tilted longitudinally and laterally.

10. Apparatus according to claim 1 in which said downwardly dished area is dished laterally of the dry dock.

11. Apparatus according to claim 1 in which said downwardly dished area is dished longitudinally of the dry dock.

12. Apparatus according to claim 1 in which said downwardly dished area is dished laterally and longitudinally of the dry dock.

13. Apparatus according to claim 1 in which said support surface is dished laterally of the dry dock for a substantial part of its length commencing at said area.

14. Apparatus according to claim 13 in which said ballast means is adapted to selectively longitudinally tilt said dry dock so that the end of said dry dock adjacent said area is lower than the opposite end of the dry dock.

15. Apparatus according to claim 13 in which said area is dished laterally and longitudinally of said dry dock.

16. A method for emptying a load of fresh water from a flexible barge floating in a body of water, said method comprising:

submerging a dry dock in said body of water;

mooring the barge over the dry dock;

raising the dry dock to engage the underside of the barge;

pumping the load of water from the barge while keeping the dry dock in engagement with the barge by raising the dry dock to keep an upper portion of the barge above the level of said body of water.

17. A method for emptying a load of fresh water from a flexible barge floating in a body of water and having an upper discharge port adjacent one end thereof, said method comprising:

submerging a dry dock in said body of water;

mooring the barge over the dry dock;

raising the dry dock to engage the underside of the barge;

introducing a discharge unit into said port;

pumping fresh water from the barge through the discharge unit until part of said load is removed from the barge;

raising the dry dock while the fresh water is being pumped from the barge to keep the dry dock in engagement with the barge, longitudinally tilting the dry dock so that it slopes downwardly toward the end of the dry dock closest to said port;

and pumping out the remainder of the load of fresh water in the barge.

18. A method according to claim 17 in which said dry dock has a downwardly dished area in its upper surface which is located directly beneath said port, said area collecting the final portion of the fresh water for discharge when the dry dock is longitudinally tilted.

* * * * *